US006304240B1

(12) United States Patent
Nagatomo

(10) Patent No.: US 6,304,240 B1
(45) **Date of Patent: *Oct. 16, 2001**

(54) DRIVE CIRCUIT FOR LIQUID CRYSTAL DISPLAY APPARATUS

(75) Inventor: Kenjirou Nagatomo, Miyazaki (JP)

(73) Assignee: Oki Electric Industry Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,214

(22) Filed: Oct. 13, 1998

(30) Foreign Application Priority Data

Dec. 8, 1997 (JP) ..... 9-356294

(51) Int. Cl.[7] ..... G09G 3/36
(52) U.S. Cl. ..... 345/89; 345/90
(58) Field of Search ..... 345/89, 95, 209, 345/210, 147, 148, 149, 211, 212, 98

(56) References Cited

U.S. PATENT DOCUMENTS

| | | | | |
|---|---|---|---|---|
| 4,712,099 | * | 12/1987 | Maeda | 345/153 |
| 4,772,881 | * | 9/1988 | Hannah | 345/150 |
| 5,659,331 | * | 8/1997 | Oh et al. | 345/89 |
| 5,835,387 | * | 11/1998 | Shou et al. | 364/606 |
| 6,052,118 | * | 4/2000 | Beeteson et al. | 345/207 |

* cited by examiner

*Primary Examiner*—Richard Hjerpe
*Assistant Examiner*—Ronald Laneau
(74) *Attorney, Agent, or Firm*—Rabin & Berdo, P.C.

(57) ABSTRACT

A dot inversion drive circuit is provided with a plurality of driver cells. The driver cells are each provided with a decoder comprising an N channel decoder including N channel transistors and a P channel decoder including P channel transistors, with gradient voltages input to the N channel decoder, gradient voltages input to the P channel decoder and one specific gradient voltage selected in correspondence to data to be output as an output voltage. Thus, according to the present invention, a dot inversion drive circuit that can be exclusively employed in the dot inversion drive method is provided to achieve a reduction in the circuit scale.

18 Claims, 14 Drawing Sheets

DRIVE CIRCUIT FOR LIQUID CRYSTAL DISPLAY APPARATUS

BACKGROUND OF THE INVENTION

The present invention relates to a drive circuit for a liquid crystal display apparatus, and more specifically, to a dot inversion drive circuit.

Typical drive methods employed for driving liquid crystal apparatuses include frame inversion, line inversion and dot inversion, and among these, line inversion and dot inversion in particular, are drive methods suited for effecting cancellation of cross talk. However, since dot inversion requires complex control signals, a line inversion drive method that offers more advantages overall is the mainstream method at present.

Since the dot inversion drive method is similar to the line inversion drive method, it is possible to adopt in the line inversion drive circuit a structure that is normally used in the line inversion drive method to implement dot inversion drive. Consequently, the main focus in the development of drive circuits for liquid crystal display apparatuses has been placed on line inversion drive circuits due to such factors as development cost and the product quality control, and such line inversion drive circuits have often been employed in the dot inversion drive method.

A line inversion drive circuit 101 is illustrated in FIG. 13. The line inversion drive circuit 101 includes driver cells 103-1 to 103-n, the number of which corresponds to the number of pixels in the liquid crystal display apparatus. The driver cells 103-1 to 103-n have a function for outputting output voltages OUT-1 to OUT-n in correspondence to input data DT-1 to DT-n respectively. It is to be noted that since driver cells 103-1 to 103-n are structured almost identically to one another, the driver cell 103-1 will be explained below as a typical example.

The driver cell 103-1 includes a gradient voltage selection circuit (hereafter referred to as a "decoder") 105 and an amplifier circuit (hereafter referred to as an "amplifier") 107. The decoder 105 selects one of input gradient voltages V1 to Vn based upon the data DT-1 during every raster cycle to output it as a decoder output Decout. It is to be noted that the explanation is given here on a case in which there are 64 gradations, i.e., the gradient voltage Vn=V64.

Next, the structure of the decoder 105 is explained. The decoder 105 comprises an area 111 including N channel transistors (hereafter referred to as an "N channel decoder area") and an area 113 includes P channel transistors (hereafter referred to as a "P channel decoder area"). FIG. 14 illustrates details of the N channel decoder area 111 and the P channel decoder area 113.

In the N channel decoder area 111, a plurality of enhancement type N channel transistors and a plurality of depletion type N channel transistors are provided in a matrix. In addition, in the direction of the rows in the figure, the drains and the sources of transistors that are adjacent in the horizontal direction are connected to each other, whereas in the direction of the columns, the gates of transistors that are adjacent in the vertical direction are connected to each other. Likewise, in the P channel decoder area 113, a plurality of enhancement type P channel transistors and a plurality of depletion type P channel transistors are provided in a matrix. In the direction of the rows, the drains and the sources of transistors that are adjacent in the horizontal direction are connected to each other, whereas in the direction of columns, the gates of transistors that are adjacent in the vertical direction are connected to each other.

The individual rows of the plurality of transistors provided in a matrix in both the N channel decoder area 111 and the P channel decoder area 113 correspond to the gradient voltages V1 to V64 respectively, whereas the individual columns correspond to the individual bits (complementary) D0, /D0 to D7, /D7 in the data DT-1. It is to be noted that the gradient voltage Vm in FIG. 14 indicates an arbitrary gradient voltage among the gradient voltages V1 to V64.

In addition, the enhancement type N channel transistors and the depletion type N channel transistors in the N channel decoder area 111 are provided so that one of the gradient voltages V1 to V64 is output as the decoder output Decout in conformance to the level of the value of the data DT-1. Likewise, the enhancement type P channel transistors and the depletion type P channel transistors in the P channel decoder area 113 are provided so that one of the gradient voltages V1 to V64 is output as the decoder output Decout in conformance to the level of the value of the data DT-1.

The driver cell 103-1 structured as described above outputs one of the gradient voltages V1 to V64 that corresponds to the data codes 00 to FF (HEX) of the data DT-1 respectively, as an output voltage OUT-1 as illustrated in FIG. 15.

Depending upon the type of liquid crystal display apparatus in use, it may be necessary to reverse the relationship between the data DT-1 and the output voltage OUT-1 in the driver cell 103-1. Namely, there is a case in which the gradient voltage V64 must be selected in correspondence to the data code 00 and the gradient voltage V1 must be selected in correspondence to the data code FF (indicated by the solid line in FIG. 15) and there is also a case in which the gradient voltage V1 must be selected in correspondence to the data code 00 and the gradient voltage V64 must be selected in correspondence to the data code FF (indicated by the dotted line in FIG. 15).

In addition, when the data DT-1 of the line inversion drive circuit 101 conforms to, for instance, the 5V specifications and the arbitrary gradient voltage Vm at the driver cell 103-1 is at 0V, the gradient voltage Vm can be output as the decoder output Decout only in the N channel decoder area 111. However, when the gradient voltage Vm is at 5V, for instance, the N channel transistors constituting the N channel decoder area 111 will not be turned on, and consequently, it will not be possible to output the gradient voltage Vm as the decoder output Decout. For this reason, in the line inversion drive method in which it is necessary to reverse the relationship between the data codes 00 to FF and the gradient voltages V1 to V64 depending upon the type of liquid crystal display apparatus, the driver cells 103-1 to 103-n always assume a structure in which both the N channel decoder area 111 and the P channel decoder area 113 are provided as illustrated in FIGS. 13 and 14.

A dot inversion drive circuit in the prior art adopts the structure of the line inversion drive circuit 101 as explained earlier. The dot inversion drive circuit in the prior art is now described in reference to FIGS. 16 and 17.

The dot inversion drive circuit in the prior art adopts a structure provided with driver cells 121, the number of which corresponds to the number of pixels in the liquid crystal display apparatus, and the driver cells 121 are each provided with a decoder 123 illustrated in FIG. 16. The decoder 123 includes two N channel decoder areas 131 and 133 and two P channel decoder areas 135 and 137. Gradient voltages V1 to V64 are input to the N channel decoder area 131 and the P channel decoder area 135, whereas gradient voltages V65 to V128 are input to the N channel decoder area 133 and the N channel decoder area 137.

In a driver cell 121 in the dot inversion drive circuit, two gradient voltages are allocated in correspondence to a single set of data, unlike in the driver cell 103-1 in the line inversion drive circuit 101 described earlier. For instance, the gradient voltage V1 and the gradient voltage V128 are selected with the data code 00 of data DT as indicated by the solid line in FIG. 17, whereas the gradient voltage V64 and the gradient voltage V65 are selected with the data code FF.

As in the case of the line inversion drive circuit 101 described above, in the driver cell 121 too, it is necessary to reverse the relationship between the data codes 00 to FF, and the gradient voltages V1 to V64 and V65 to V128 depending upon the type of the liquid crystal display apparatus, as indicated with the solid line and the dotted line in FIG. 17. However, the lower gradient voltages V1 to V64 and the upper gradient voltages V65 to V128 are never reversed relative to a reference voltage Vc. In addition, one of the gradient voltages V1 to V64 that are lower than the reference voltage Vc and one of the gradient was V65 to V128 that are higher than the reference voltage Vc are always output alternately as an output voltage OUT of the driver cell 121 during every raster cycle. For instance, the gradient voltage V1 and the gradient voltage V128 selected with the data code 00 are alternately output as the output voltage OUT. Furthermore, when one of the two driver cells that correspond to adjacent pixels in the liquid crystal display apparatus is outputting one of the upper gradient voltages V65 to V128, the other driver cell will always output one of the lower gradient voltages V1 to V64.

As explained above, while the dot inversion drive method has a number of features that are common with those of the line inversion drive method, it also has its own unique functions. However, as mentioned earlier, since a line inversion drive circuit structure is adopted in the dot inversion drive method in many cases in the prior art, the scale of the drive circuit in a liquid crystal display apparatus in the dot inversion drive method is bound to become excessively large.

SUMMARY OF THE INVENTION

An object of the present invention, which has been completed by addressing the problem of a dot inversion drive circuit in the prior art discussed above, is to provide a new and improved dot inversion drive circuit that can be exclusively employed in the dot inversion drive method so that the scale of the drive circuit can be reduced compared to that of the line inversion drive circuit adopted in the dot inversion drive method and so that optimization in the dot inversion drive method can be achieved.

Another object of the present invention is to provide a new and improved drive circuit for a liquid crystal display apparatus which achieves a reduction in the circuit scale of the drive circuit by simplifying the driver cells constituting the drive circuit of the liquid crystal display apparatus and in particular by simplifying the structure of the decoders.

In order to achieve the objects described above, in a first aspect of the present invention, a drive circuit for a liquid crystal display apparatus that selects one gradient voltage signal among a plurality of gradient voltage signals is provided. This drive circuit for a liquid crystal display apparatus is it is provided with a plurality of driver cells, each comprising a first decoder area (which is known to those of ordinary skill in the art as including a decoder) constituted with only N channel transistors for selecting gradient voltage signals that are lower than a specific reference voltage level among the plurality of gradient voltage signals and a second decoder area (which is known to those of ordinary skill in the art as including a decoder) including P channel transistors for selecting gradient voltage signals whose levels are higher than the specific reference voltage level among the plurality of gradient voltage signals.

In this structure, the plurality of gradient voltage signals are assigned to either the first decoder area including the N channel transistors or the second decoder including the P channel transistors in correspondence to their voltage ranges. Thus, the circuit scale of the driver cells is halved compared to the circuit scale of driver cells in the prior art, in which decoders each including N channel transistors, and P channel transistors select one gradient voltage signal from among all the gradient voltage signals. Consequently, a reduction in the circuit scale is achieved while still fulfilling the functions achieved by the drive circuit in the prior art.

In addition, in a second aspect of the present invention, a drive circuit for a liquid crystal display apparatus that selects one gradient voltage signal among a plurality of gradient voltage signals, which is provided with one driver cell having a first decoder including N channel transistors for selecting gradient voltage signals that are lower than a specific reference voltage level among the plurality of gradient voltage signals, another driver cell having a second decoder including P channel transistors for selecting gradient voltage signals whose levels are higher than the specific reference voltage level among the plurality of gradient voltage signals and a selection circuit that is capable of selecting either a gradient voltage signal selected at the one driver cell or a gradient voltage signal selected at the other driver cell in correspondence to a selection signal, is provided.

That driver circuit for a liquid crystal display apparatus described above makes it possible to halve the circuit scale of the driver cells compared to that in the prior art, since, with the reference voltage level set at the middle of the plurality of gradient voltage signal levels, for instance, each driver cell only needs to select one gradient voltage signal from among half of the plurality of gradient voltage signals. Consequently, a reduction in the circuit scale is achieved compared to that in the drive circuit in the prior art.

The first decoder area may be includes a first sub decoder area employed for selecting a specific number N of gradient voltage signals from among a plurality of input gradient voltage signals and a second sub decoder area for selecting one gradient voltage signal from among the specific number N of gradient voltage signals. This structure makes it possible to provide N channel transistors in an efficient manner in the first sub decoder area and in the second sub decoder area, so that the number of N channel transistors to be provided in the entire first decoder area can be kept to an absolute minimum. Consequently, a reduction in the circuit scale is achieved compared to that in a drive circuit in the prior art.

In addition, the second decoder area may be include a third sub decoder area for selecting a specific number M of gradient voltage signals from among a plurality of input gradient voltage signals and a fourth sub decoder area employed for selecting one gradient voltage signal from among the specific number M of gradient voltage signals. This structure makes it possible to provide P channel transistors in an efficient manner in the third sub decoder area and the fourth sub decoder area, so that the number of P channel transistors required for the entire second decoder area can be kept at an absolute minimum. Thus, a reduction in the circuit scale is achieved compared to that in a drive circuit in the prior art.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments.

DETAILED DESCRIPTION OF THE PREFERRED EMBODIMENTS

The following is a detailed explanation of the preferred embodiments of the drive circuit for a liquid crystal display apparatus according to the present invention in reference to the attached drawings. It is to be noted that the same reference numbers are assigned to components having almost identical functions and structures in the following explanation and in the attached drawings to preclude the necessity for repeated explanation thereof.

First Embodiment

Figure 1:
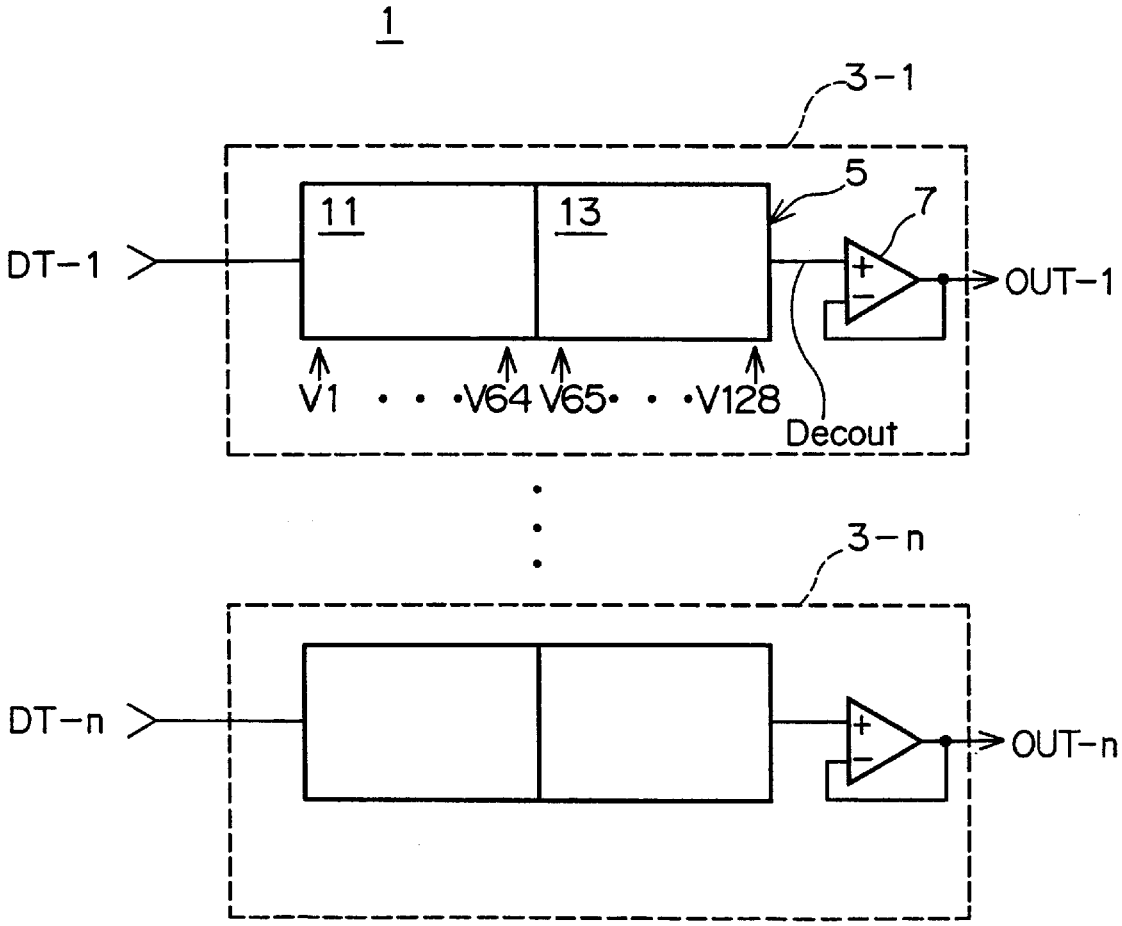
FIG. 1 is a block diagram illustrating the structure of the dot inversion drive circuit in the first embodiment of the present invention.

A dot inversion drive circuit 1 in the first embodiment includes driver cells 3-1 to 3-n, the number of which corresponds to the number of pixels in the liquid crystal display apparatus, as illustrated in FIG. 1. The driver cells 3-1 to 3-n are provided with a function for outputting output voltages OUT-1 to OUT-n in correspondence to input data DT-1 to DT-n respectively. Since the driver cells 3-1 to 3-n have a structure almost identical to one another, the explanation is given on the driver cell 3-1 as a typical example.

The driver cell 3-1 comprises a decoder 5 and an amplifier 7. The decoder 5 selects one of input gradient voltages V1 to Vn based upon the data DT-1 at every raster cycle to output it as a decoder output Decout. An explanation is given here on a case in which the gradient voltage Vn=V128.

Figure 2:
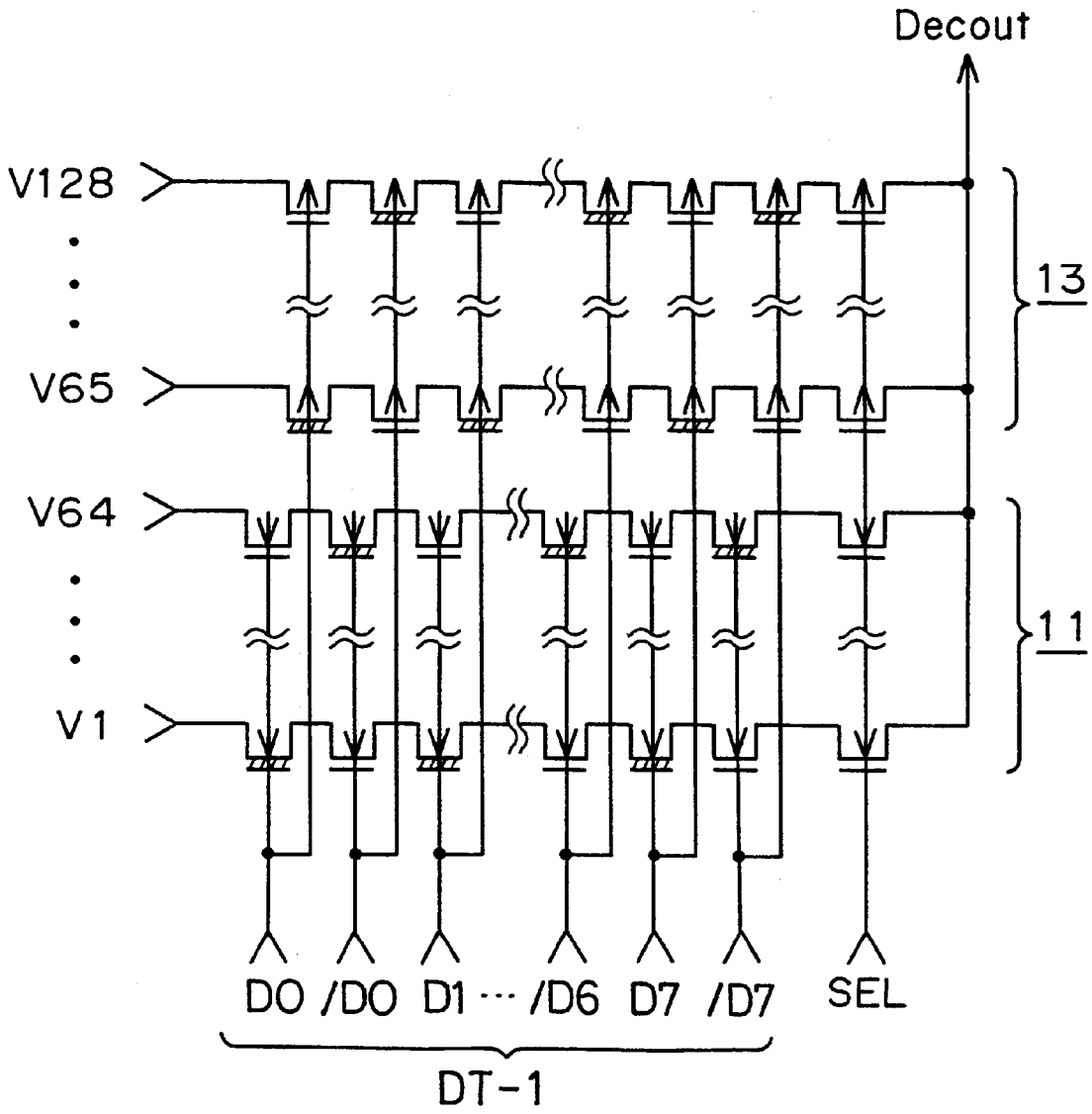
FIG. 2 is a circuit diagram illustrating details of each decoder in the dot inversion drive circuit illustrated in FIG. 1.

Next, the structure of the decoder 5 is explained. The decoder 5 comprises an N channel decoder area 11 having a first decoder area and a P channel decoder area 13 having a second decoder area. FIG. 2 shows details of the N channel decoder area 11 and the P channel decoder area 13.

In the N channel decoder area 11, a plurality of enhancement type N channel transistors and a plurality of depletion type N channel transistors are provided in a matrix. In the direction of the rows in FIG. 2, the drains and the sources of transistors that are adjacent in the horizontal direction are connected to each other, whereas in the direction of the columns, the gates of transistors that are adjacent in the vertical direction are connected to each other. Likewise in the P channel decoder area 13, a plurality of enhancement type P channel transistors and a plurality of depletion type P channel transistors are provided in a matrix. In the direction of the rows in FIG. 2, the drains and the sources of transistors that are adjacent in the horizontal direction are connected to each other, whereas in the direction of the columns, the gates of transistors that are adjacent in the vertical direction are connected to each other.

The individual rows of the plurality of N channel transistors provided in a matrix in the N channel decoder area 11 correspond to the gradient voltages V1 to V64, whereas the individual rows of the plurality of P channel transistors provided in a matrix in the P channel decoder area 13 correspond to the gradient voltages V65 to V128. The individual bits (complementary) D0, /D0 to D7, /D7 of the data DT-1 are input the transistors in the individual columns.

In addition, the enhancement type N channel transistors and the depletion type N channel transistors in the N channel decoder area 11 are provided so that one of the gradient voltages V1 to V64 is output as the decoder output Decout in conformance to the level of the value of the data DT-1. Likewise, the enhancement type P channel transistors and the depletion type P channel transistors in the P channel decoder area 13 are provided so that one of the gradient voltages V65 to V128 is output as the decoder output Decout in conformance to the level of the value of the data DT-1.

At the last output stage in the direction of rows in the N channel decoder area 11, an enhancement type N channel transistor is provided, and at the last output stage in the direction of rows in the P channel decoder area 13, an enhancement type P channel transistor is provided. These enhancement type transistors can be all controlled with a selection signal SEL.

Figure 3:
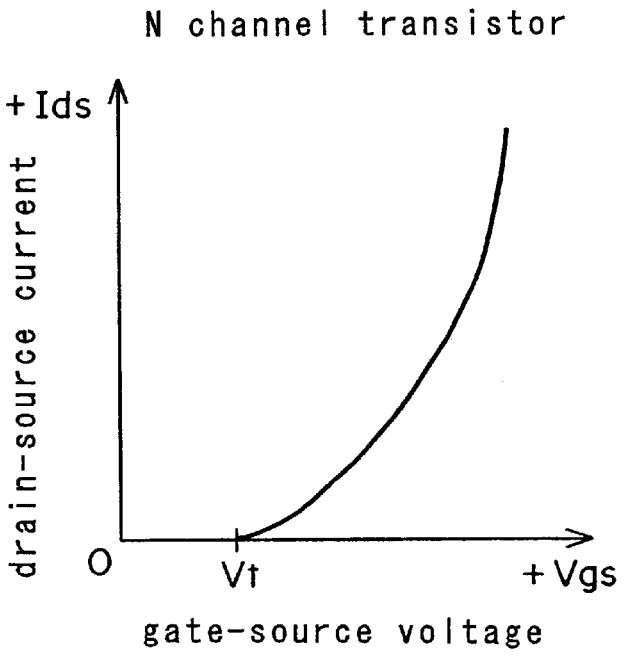
FIG. 3 is a characteristics curve used to explain the operation of N channel transistors.
Figure 4:
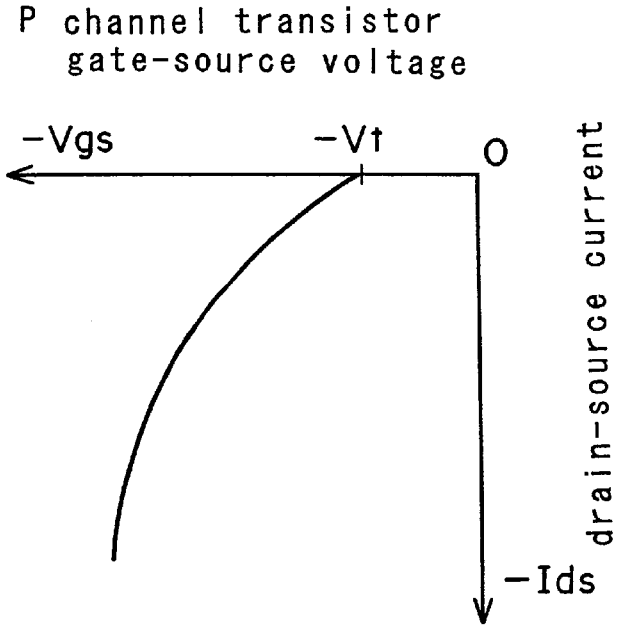
FIG. 4 is a characteristics curve used to explain the operation of P channel transistors.

In reference to FIGS. 3 and 4, the operations of the N channel transistors and the P channel transistors are explained. Either an N channel transistor or a P channel transistor is turned on when the voltage Vgs between the gate and the source is at a level between 0V and the threshold voltage Vt. Each transistor is turned on when the voltage Vgs between the gate and the source exceeds the threshold voltage Vt. Consequently, when 0 to 2.4V are assigned to the gradient voltages V1 to V64 and 2.6 to 5.0V are assigned to the gradient voltages V65 to V128 respectively, for instance, one gradient voltage among the gradient voltages V1 to V64 can be selected to be output as the decoder output Decout in the N channel decoder area 11 including the N channel transistors and one gradient voltage among the gradient voltages V65 to V128 can be selected to be output as a decoder output Decout in the P channel decoder area 13 including the P channel transistors.

Figure 5:
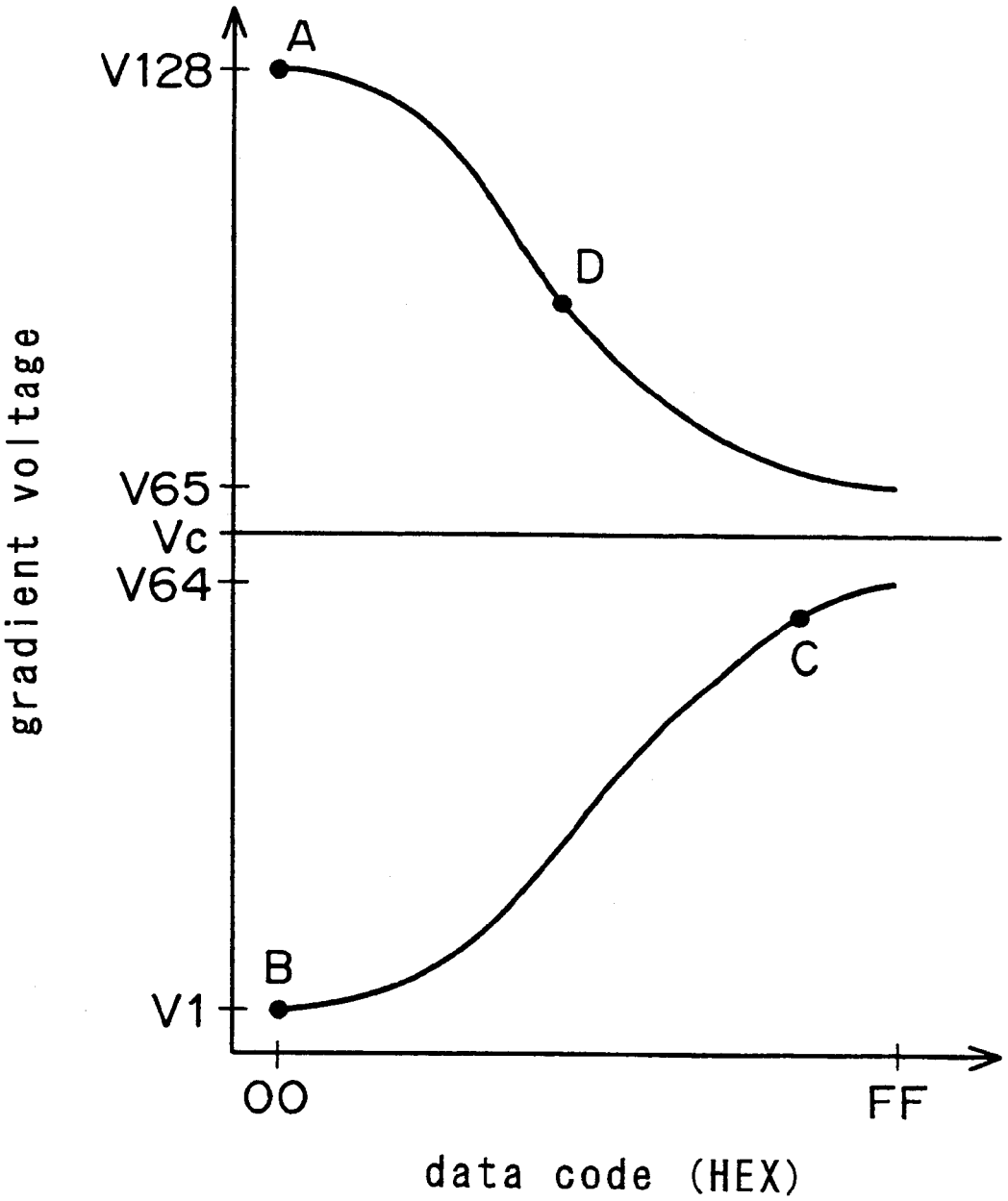
FIG. 5 is a characteristics curve used to explain the operation of the dot inversion drive circuit in FIG. 1.

Next, the operation of the dot inversion drive circuit 1 in the first embodiment is explained in reference to FIGS. 2 and 5. Since the dot inversion drive circuit 1 a plurality of driver cells 3-1 to 3-n as explained earlier and these driver cells 3-1 to 3-n have a structure almost identical to one another, an explanation will be given here on the operation of the driver cell 3-1 as a typical example.

When a data code 00, for instance, is input to the driver cell 3-1 with specific timing, i.e., when D0 to D7 of the data DT-1 are all set to "0" and /D0 to /D7 are all set to "1," all the N channel transistors corresponding to the gradient voltage V1 and all the P channel transistors corresponding to the gradient voltage V128 are turned on. At the same time, at least one of the transistors corresponding to each of the gradient voltages V2 to V127 is in an off state. At this point, by setting the selection signal SEL to low level, the gradient voltage V128 is output as the decoder output Decout (point A in FIG. 5).

In the next raster cycle, the selection still SEL is set to high level. If the data code remains unchanged at 00, the gradient voltage V1 is output as the decoder output Decout (point B in FIG. 5).

In contrast, if the data code has changed, a gradient voltage corresponding to the data code is selected from the gradient voltages V2 to V64 that are lower than a reference voltage Vc and is output as the decoder output Decout (point C in FIG. 5).

In the next raster cycle, the selection signal SEL is reset to low level. If the data code has changed, one gradient voltage corresponding to the data code among the gradient voltages V65 to V128 that are higher than the reference voltage Vc is selected and output as the decoder output Decout (point D in FIG. 5).

As explained above, through the dot inversion drive circuit 1 in the first embodiment, the operation that is characteristic in the dot inversion drive method in which one voltage from among the gradient voltages V65 to V128 that are higher than the reference voltage Vc and one voltage from among the gradient voltages V1 to V64 that are lower than the reference voltage Vc are alternately output by switching the signal level of the selection signal SEL at every raster cycle is achieved.

Furthermore, in each of the driver cells 3-1 to 3-n constituting the dot inversion drive circuit 1, the gradient voltages V1 to V64 lower than the reference voltage Vc are selected by the N channel decoder area 11 constituted of only N channel transistors and the gradient voltages V65 to V128 higher than the reference voltage Vc are selected in the P channel decoder area 13 constituted of only P channel transistors. In other words, since the circuit scale can be halved in comparison to that of the driver cells 121 constituting the dot inversion drive circuit in the prior art, a significant reduction in the chip size is achieved by the dot inversion drive circuit 1 in the first embodiment compared to that in the prior art.

Second Embodiment

The driver cells 3-1 and 3-2 in the dot inversion drive circuit 1 in the first embodiment described above may be replaced by driver cells 21-1 and 21-2 and switching circuits 31, 33, 35 and 37 functioning as a selection circuit. The following is an explanation of a dot inversion drive circuit in the second embodiment provided with the driver cells 21-1 and 21-2 and the switching circuits 31 to 37. It is to be noted that since components other than the driver cells 21-1 and 21-2 and the switching circuits 31 to 37 in the dot inversion drive circuit in the second embodiment are almost identical to those in the dot inversion drive circuit 1 in the first embodiment, only the driver cells 21-1 and 21-2 and the switching circuits 31 to 37 are explained here.

Figure 6:
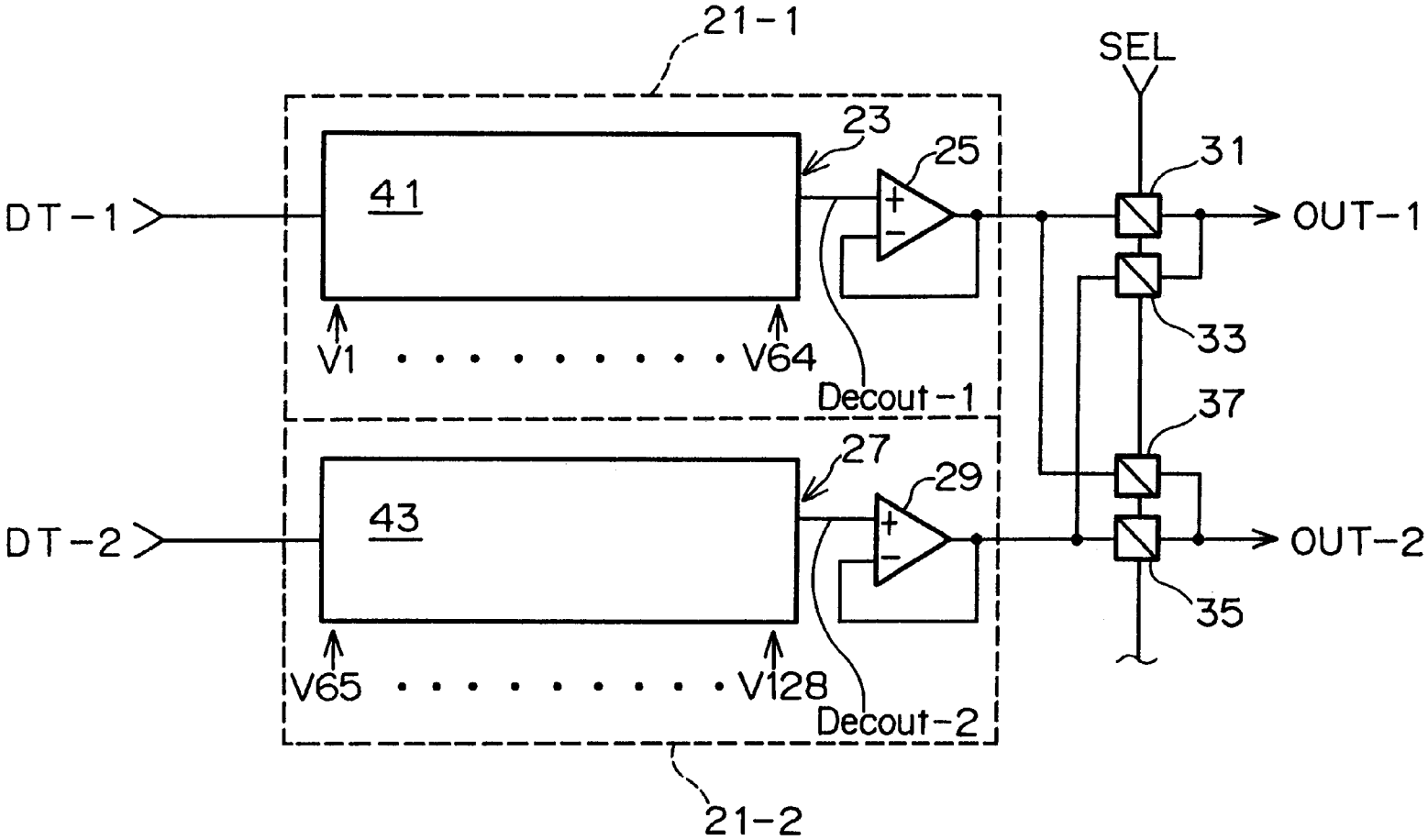
FIG. 6 is a block diagram illustrating the structures of driver cells in the dot inversion drive circuit in a second embodiment of the present invention.

As illustrated in FIG. 6, the driver cell 21-1 includes a decoder 23 and an amplifier 25 and the driver cell 21-2 includes is constituted of a decoder 27 and an amplifier 29. In addition, the switching circuits 31 and 37 are commonly connected to the output of the amplifier 25 that amplifies a decoder output Decout-1 from the decoder 23 whereas the switching circuit 33 and the switching circuit 35 are commonly connected to the output of the amplifier 29 that amplifies a decoder output Decout-2 from the decoder 27. The switching circuit 31 and the switching circuit 33 share a common output through which an output voltage OUT-1 is output, and likewise, the switching circuit 35 and the switching circuit 37 share a common output through which an output voltage OUT-2 is output. On/off control of the switching circuits 33, 35, 37 and 39 is implemented with a selection signal SEL.

Next, the structures of the decoder 23 at the driver cell 21-1 and of the decoder 27 at the driver cell 21-2 are explained.

To the decoder 23, which includes is constituted of an N channel decoder area 41, gradient voltages V1 to V64 and data DT-1 are input. Gradient voltages V65 to V128 and data DT-2 are input to the decoder 27 which is constituted of a P channel decoder area 43.

Figure 7:
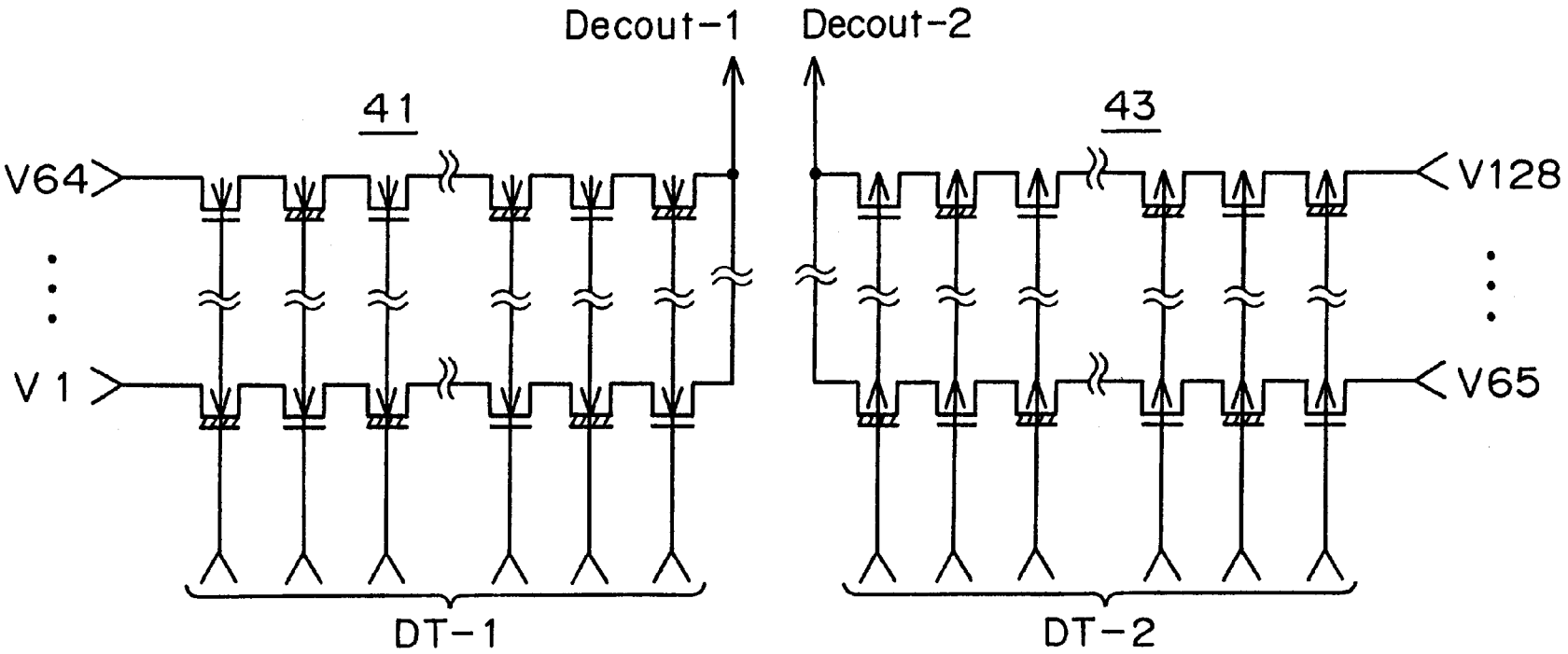
FIG. 7 is a circuit diagram illustrating details of the decoder in the driver cell in FIG. 6.

In addition, the N channel decoder area 41 assumes a structure in which, as illustrated in FIG. 7, a plurality of enhancement type N channel transistors and a plurality of depletion type N channel transistors are provided in a matrix. In the direction of the rows in FIG. 7, the drains and the sources of transistors that are adjacent provided in the horizontal direction are connected with each other and in the direction of the columns, the gates of transistors that are adjacent in the vertical direction are connected with each other. Likewise, the P channel decoder area 43 assumes a structure in which a plurality of enhancement type P channel transistors and a plurality of depletion type P channel transistors are provided in a matrix. In the direction of the rows, the drains and the sources of transistors that are adjacent provided in the horizontal direction are connected to each other and in the direction of the columns, the gates of transistors that are adjacent in the vertical direction are connected to each other.

The individual rows of the plurality of N channel transistors provided in a matrix in the N channel decoder area 41 correspond to the gradient voltages V1 to V64. In addition, the individual rows of the plurality of P channel transistors provided in a matrix in the P channel decoder area 43 correspond to the gradient voltages V65 to V128. Individual bits of the data DT-1 are input to the gates of the N channel transistors in the individual columns in the N channel decoder area 41. Likewise, the individual bits of the data DT-2 are input to the gates of the P channel transistors in the individual columns in the P channel decoder area 43.

Furthermore, the enhancement type N channel transistors and the depletion type N channel transistors in the N channel decoder area 41 are provided so that a gradient voltage V1 to V64 is output as a decoder output Decout-1 in correspondence to the level of the value of the data DT-1. Likewise, the enhancement type P channel transistors and the depletion type P channel transistors in the P channel decoder area 43 are provided so that one of the gradient voltages V65 to V128 is output as the decoder output Decout-2 in correspondence to the level of the value of the data DT-2.

Next, the operation of the dot inversion drive circuit in the second embodiment is explained. First, the switching circuits 31 and 35 are turned on and the switching circuits 33 and 37 are turned off with the selection signal SEL. Then, when the data DT-1 are input to the driver cell 21-1 with specific timing, the driver cell 21-1 selects a specific gradient voltage among the gradient voltages V1 to V64 to output it as the output voltage OUT-1. In addition, when the data DT-2 are input to the driver cell 21-2, the driver cell 21-2 selects a specific gradient voltage among the gradient voltages V65 to V128 to output it as the output voltage OUT-2.

A dot inversion drive circuit must alternately output one of the gradient voltages V65 to V128 that are higher than a reference voltage Vc and one of the gradient voltages V1 to V64 that are lower than the reference voltage Vc in every raster cycle. Consequently, in the following raster cycle after one of the gradient voltages V1 to V64 is output as the output voltage OUT-1 and one of the gradient voltages V65 to V128 is output as the output voltage OUT-2, the switching circuits 33 and 37 are turned on and the switching circuits 31 and 35 are turned off with the selection signal SEL. Thus, when the data DT-1 and DT-2 are input, a specific voltage among the gradient voltages V1 to V64 is selected to be output as the output voltage OUT-2 and a specific voltage among the gradient voltages V65 to V128 is selected to be output as the output voltage OUT-1.

As explained above, the dot inversion drive circuit in the second embodiment makes it possible to select a voltage from among the gradient voltages V1 to V64 in one driver cell, to select a voltage from among the gradient voltages V65 to V128 in another driver cell and to switch between the output destinations of the two selected gradient voltages with the selection signal SEL. Consequently, the chip size can be halved with the dot inversion drive circuit in the second embodiment compared to that achieved by the dot inversion drive circuit 1 in the first embodiment.

Now, the amplifiers 25 and 29 provided in the driver cells 21-1 and 21-2 respectively in the dot inversion drive circuit in the second embodiment respectively amplify the gradient voltages V1 to V64 and the gradient voltages V65 to V128. In contrast, the gradient voltages V1 to V128 are input to the amplifiers 7 provided in the driver cells 3-1 to 3-n in the dot inversion drive circuit 1 in the first embodiment. In other words, in the amplifiers 25 and 29 in the second embodiment, the input voltage specifications can be reduced to half those for the amplifiers 7 in the first embodiment. As a result, the circuits constituting the amplifiers 25 and 29 can be simplified to achieve a cost reduction and an improvement in operational accuracy.

Third Embodiment

Figure 8:
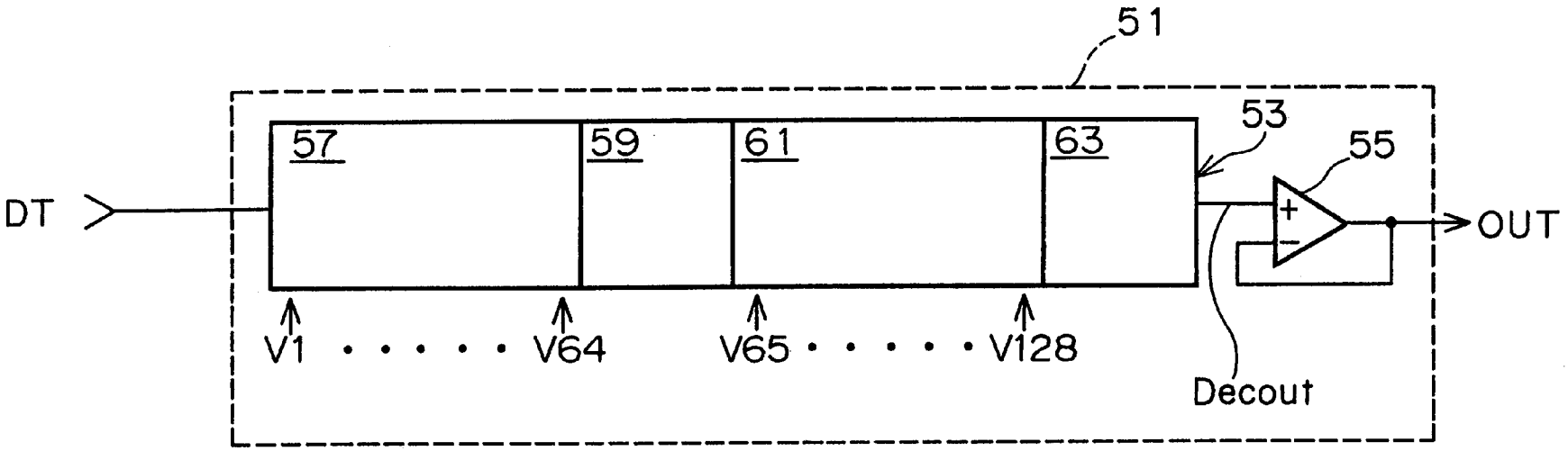
FIG. 8 is a block diagram illustrating the structure of each driver cell in the dot inversion drive circuit in the third embodiment of the present invention.

The driver cell 3-1 in the dot inversion drive circuit 1 in the first embodiment described earlier may be replaced by a driver cell 51 illustrated in FIG. 8. The following is an explanation of a dot inversion drive circuit in the third embodiment provided with the driver cell 51. Since components other than the driver cell 51 in the dot inversion drive circuit in the third embodiment are almost identical to those in the dot inversion drive circuit 1 in the first embodiment, only the driver cell 51 is explained here.

As illustrated in FIG. 8, the driver cell 51 includes a decoder 53 and an amplifier 55. The decoder 53 comprises a first N channel decoder area 57 including a first sub decoder area, a second N channel decoder area 59 constituting a second sub decoder area, a first P channel decoder area 61 constituting a third sub decoder area and a second P channel decoder area 63 constituting a fourth sub decoder area. Gradient voltages V1 to V64 are input to the first N channel decoder area 57, and gradient voltages V65 to V128 are input to the first P channel decoder area 61.

Figure 9:
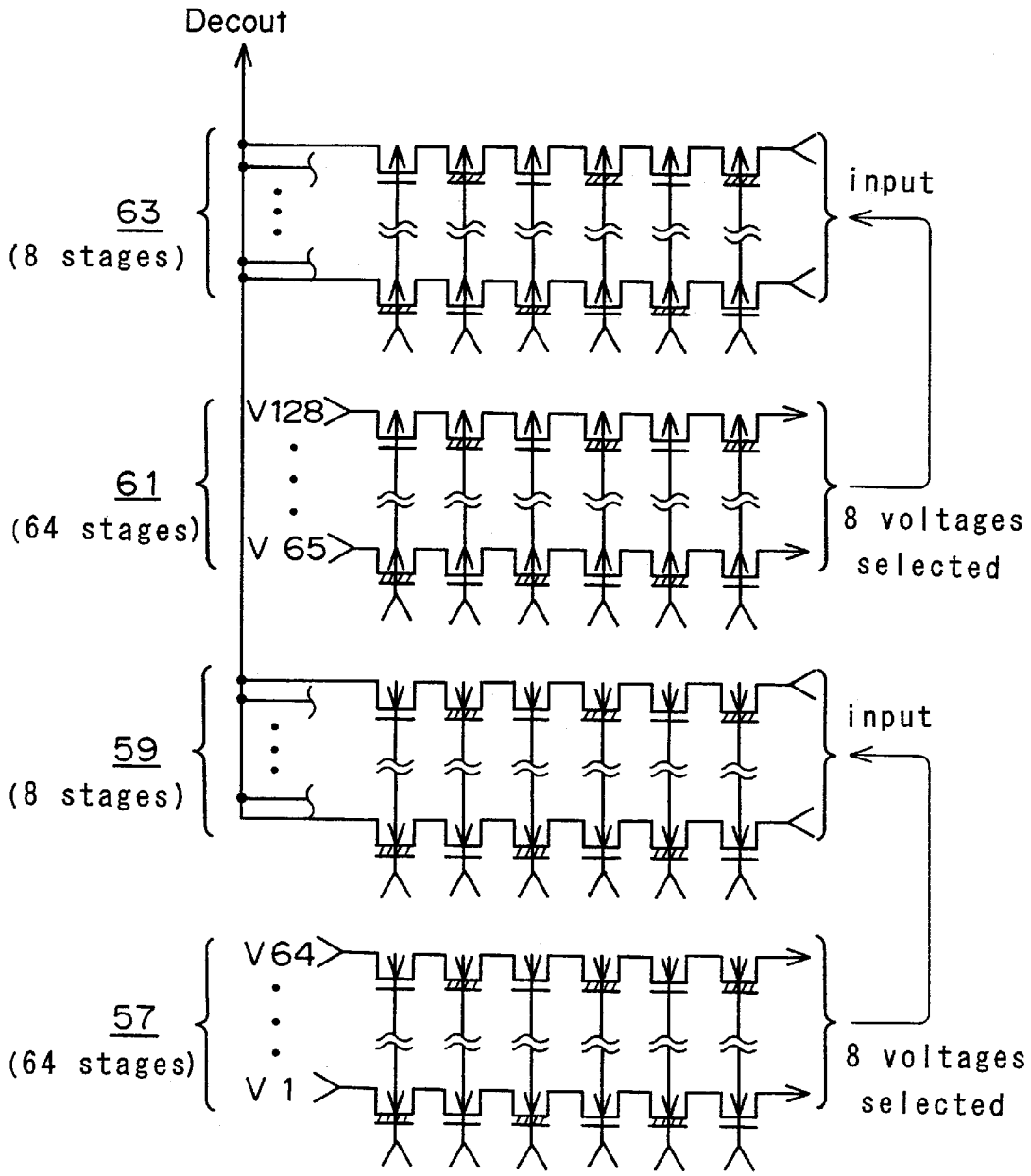
FIG. 9 is a circuit diagram illustrating details of the decoder in the driver cell in FIG. 8.

In addition, as illustrated in FIG. 9, the first and second N channel decoder areas 57 and 59 are each provided with a plurality of enhancement type N channel transistors and a plurality of depletion type N channel transistors arrayed in a matrix, and the first and second P channel decoder areas 61 and 63 are each provided with a plurality of enhancement type P channel transistors and a plurality of depletion type P channel transistors arrayed in a matrix. In the direction of the rows in FIG. 9, the drains and the sources of transistors that are adjacent in the horizontal direction are connected to each other and in the direction of the columns, the gates of transistors that are adjacent in the vertical direction are connected to each other. It is to be noted that in the following explanation, data DT are 6-bit data.

The individual rows of the plurality of N channel transistors arrayed in a matrix in the first N channel decoder area 57 corresponds to the gradient voltages V1 to V64. In addition, the lower-order bits (complementary) in the data DT are input to the gates of the N channel transistors in the individual columns in the first N channel decoder area 57. In other words, in the first N channel decoder area 57, eight voltages among the gradient voltages V1 to V64 can be selected with the lower three bits of the data DT.

The N channel transistors arrayed in a matrix in the second N channel decoder area 59 achieve an eight-stage structure, and the eight voltages selected in the first N channel decoder area 57 are each input to one of the eight stages. In addition, the higher-order bits (complementary) of the data DT are input to the gates of the N channel transistors in the individual columns in the second N channel decoder area 59. Namely, in the second N channel decoder area 59, one voltage out of the eight voltages input from the first N channel decoder area 57 can be selected with the higher-order three bits of the data DT to be output as the decoder output Decout.

Likewise, in the first P channel decoder area 61, eight voltages among the gradient voltages V65 to V128 are selected with the lower-order three bits of the data DT, so that in the second P channel decoder area 63, one voltage of the eight voltages is selected with the higher-order three bits of the data DT to be output as the decoder output Decout.

As explained above, the driver cell 51 in the dot inversion drive circuit in the third embodiment is includes decoders that are controlled by the higher-order three bits of the data DT and the decoders that are controlled by the lower-order three bits, to greatly reduce the number of transistors in the configuration while still fulfilling the functions achieved by the decoder 5 in the first embodiment. Consequently, the dot inversion drive circuit in the third embodiment provided with the driver cell 51 achieves further miniaturization while achieving almost identical functions as those achieved in the dot inversion drive circuit 1 in the first embodiment.

Fourth Embodiment

Figure 10:
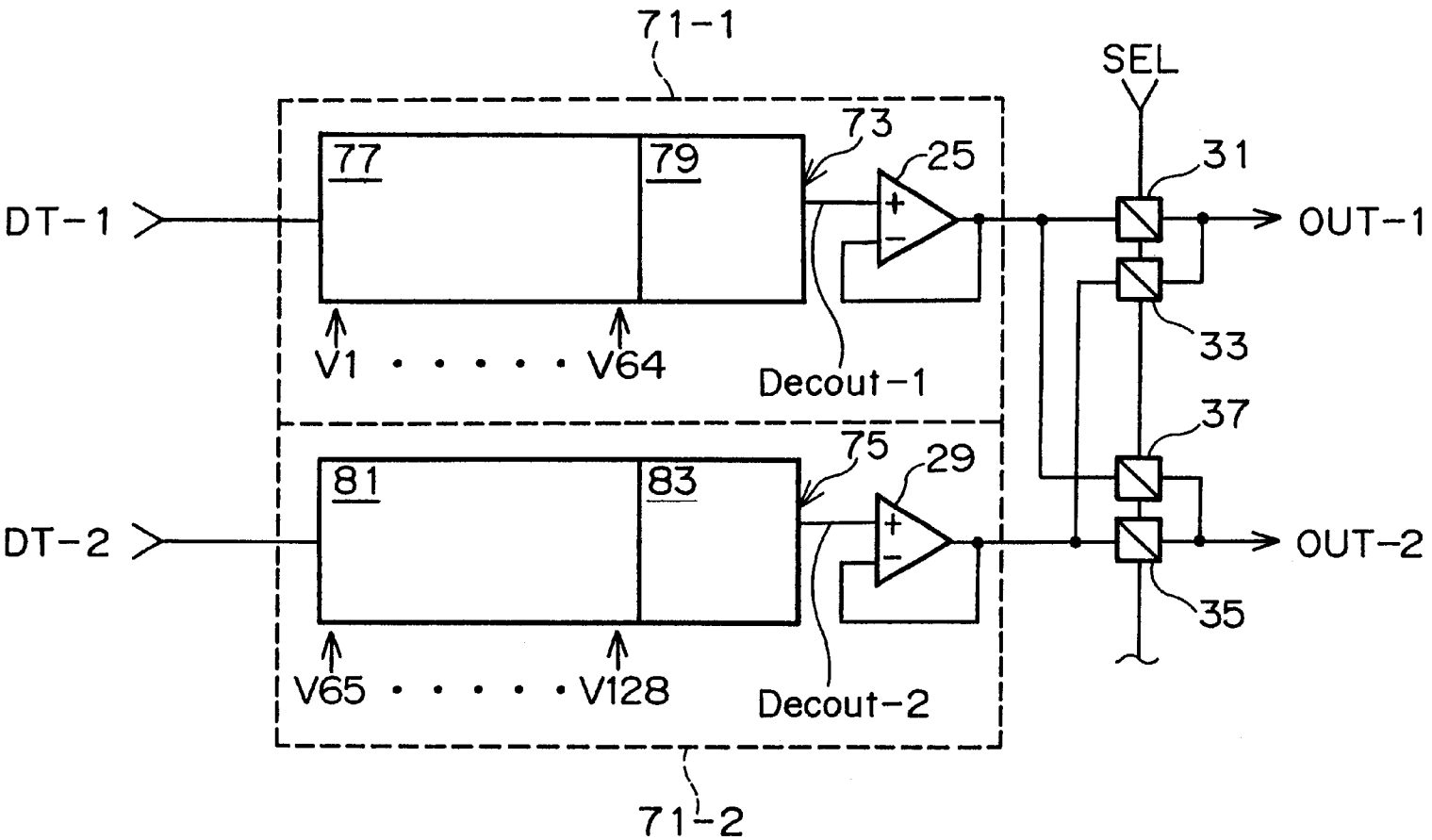
FIG. 10 is a block diagram illustrating the structures of driver cells in the dot inversion drive circuit in the fourth embodiment of the present invention.

The driver cells 3-1 and 3-2 in the dot inversion drive circuit 1 in the first embodiment may be replaced with driver cells 71-1 and 71-2 illustrated in FIG. 10 and switching circuits 31, 33, 35 and 37. The following is an explanation of the dot inversion drive circuit in the fourth embodiment provided with the driver cells 71-1 and 71-2 and the switching circuits 31–37. Since components other than the driver cells 71-1 and 71-2 and the switching circuits 31–37 in the dot inversion drive circuit in the fourth embodiment are almost identical to those in the dot inversion drive circuit 1 in the first embodiment, only the driver cells 71-1 and 71-2 and the switching circuits 31 to 37 are explained here.

As illustrated in FIG. 10, the driver cell 71-1 comprises a decoder 73 and an amplifier 25, and the driver cell 71-2 comprises a decoder 75 and an amplifier 29. The switching circuit 31 and the switching circuit 37 are commonly connected to the output of the amplifier 25 that amplifies the decoder output Decout-1 from the decoder 73, whereas the switching circuit 33 and the switching circuit 35 are commonly connected to the output of the amplifier 29 that amplifies the decoder output Decout-2 from the decoder 75. In addition, the switching circuit 31 and the switching circuit 33 share a common output through which an output voltage OUT-1 is output, and likewise the switching circuit 35 and the switching circuit 37 share a common output through which an output voltage OUT-2 is output. On/off control of the switching circuits 33, 35, 37 and 39 is achieved with a selection signal SEL.

Next, the structures of the decoder 73 and the decoder 75 are explained. The decoder 73 includes a first N channel decoder area 77 and a second N channel decoder area 79, with gradient voltages V1 to V64 and data DT-1 input to the first N channel decoder area 77. The decoder 75 includes a first P channel decoder area 81 and a second P channel decoder area 83, with gradient voltages V65 to V128 and data DT-2 input to the first P channel decoder area 81.

Figure 11:
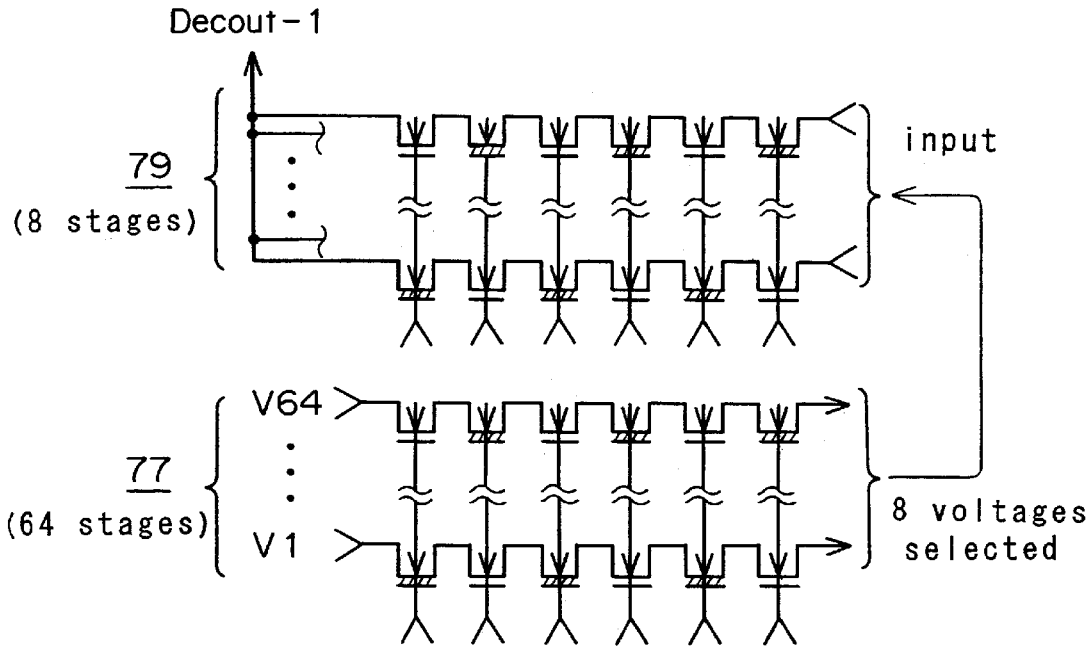
FIG. 11 is a circuit diagram illustrating details of the decoder in one driver cell in FIG. 10.
Figure 12:
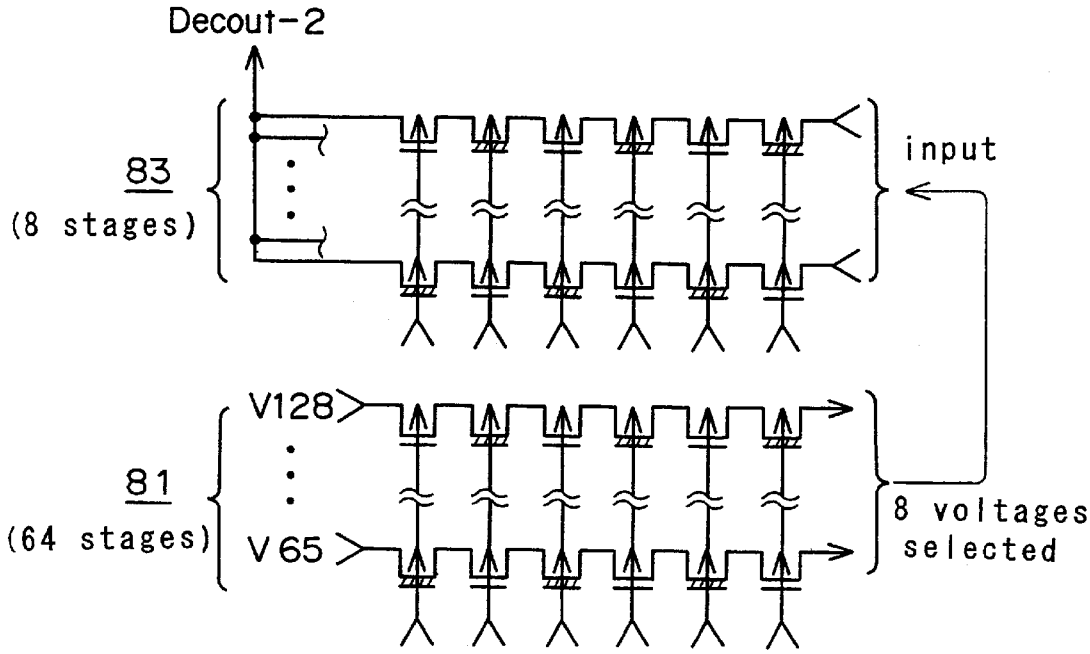
FIG. 12 is a circuit diagram illustrating details of the decoder in another driver cell in FIG. 10.
Figure 13:
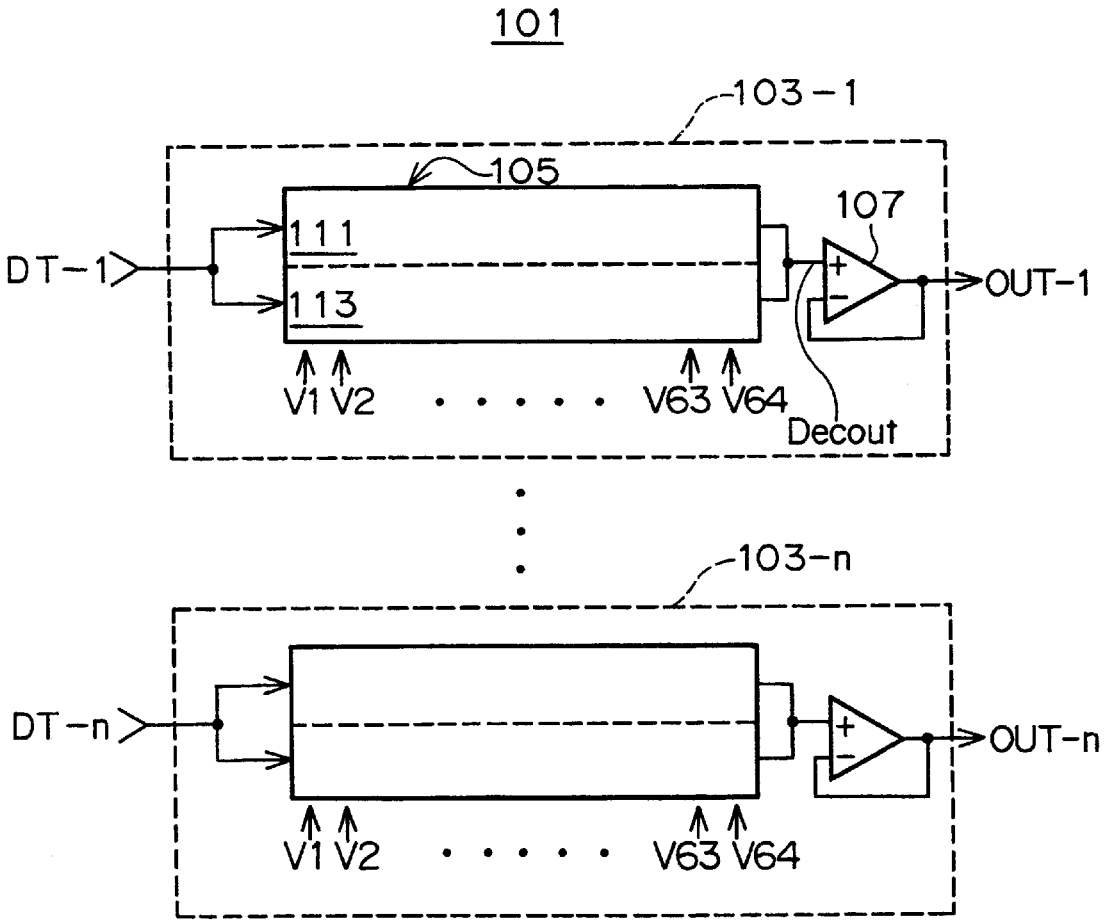
FIG. 13 is a block diagram illustrating the structure of a line inversion drive circuit.
Figure 14:
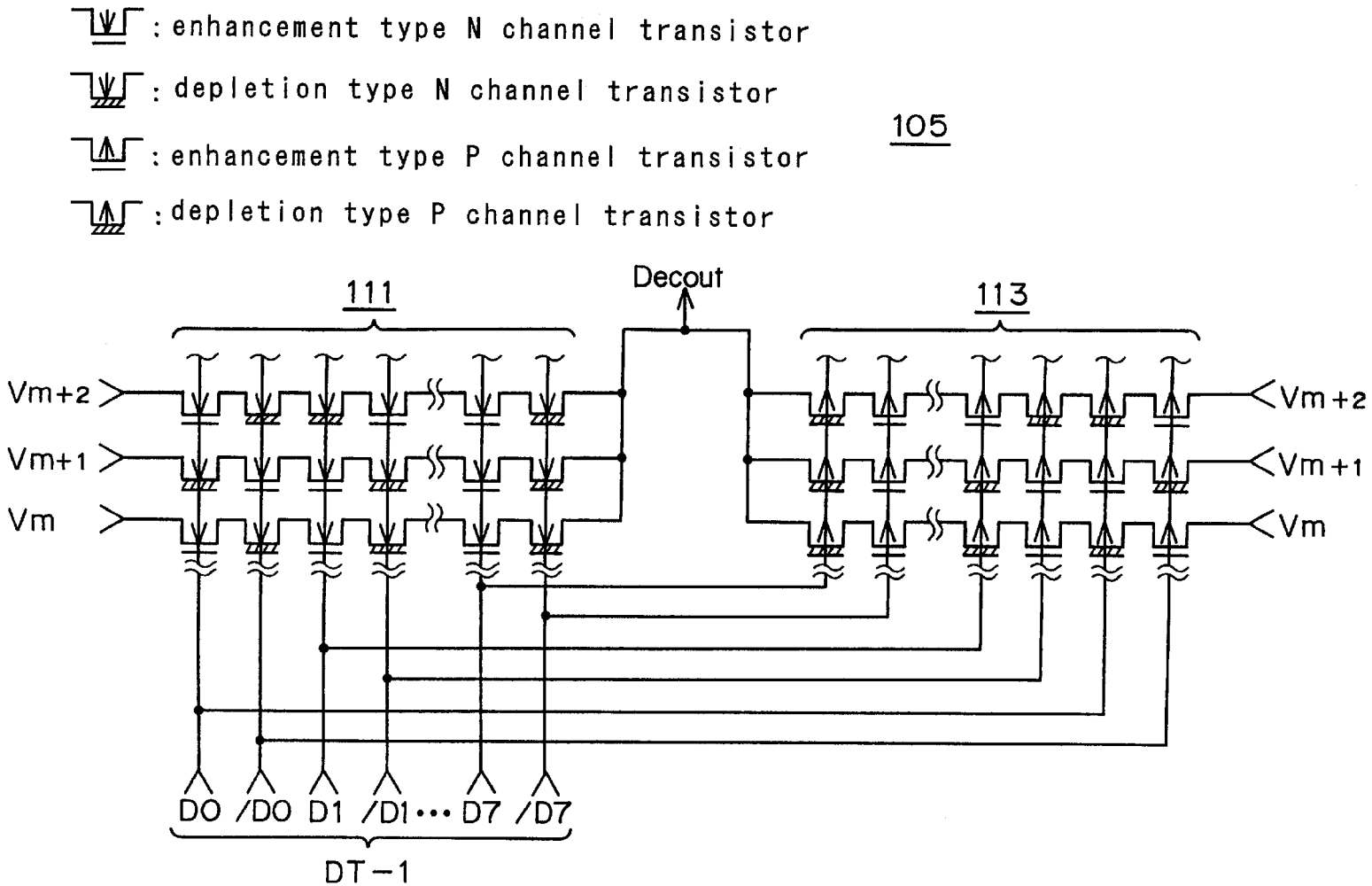
FIG. 14 is a circuit diagram illustrating details of a decoder in the line inversion drive circuit illustrated in FIG. 13.
Figure 15:
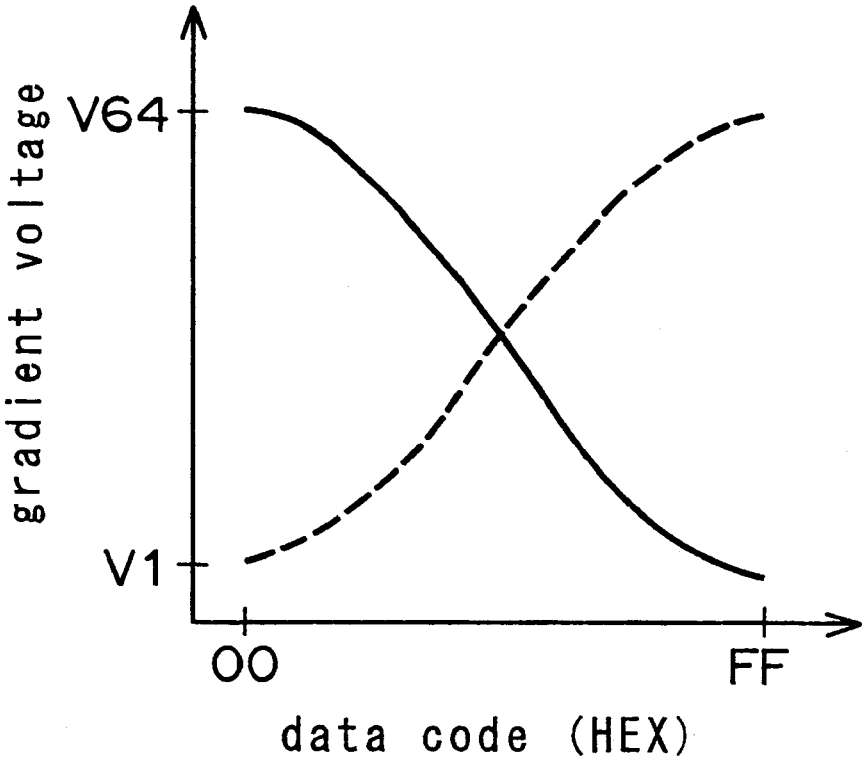
FIG. 15 is a characteristics curve used to explain the operation of the line inversion drive circuit in FIG. 13.
Figure 16:
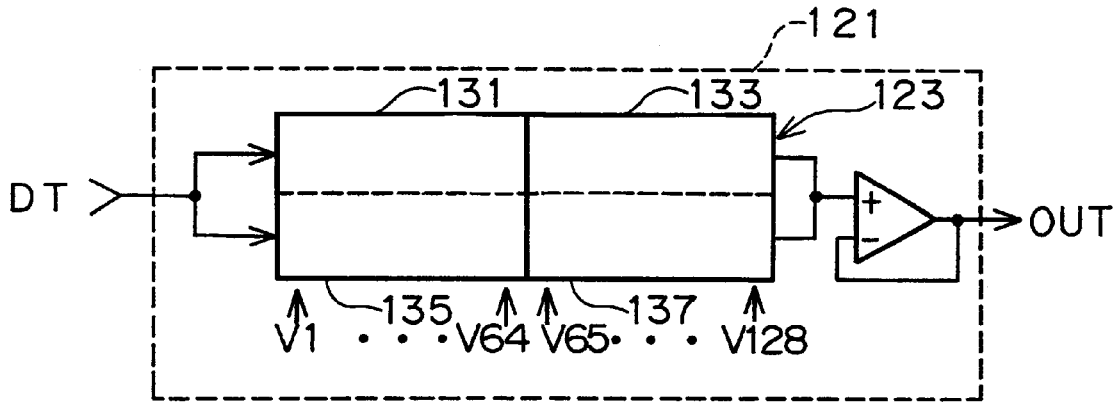
FIG. 16 is a block diagram illustrating the structure of a dot inversion drive circuit in the prior art.
Figure 17:
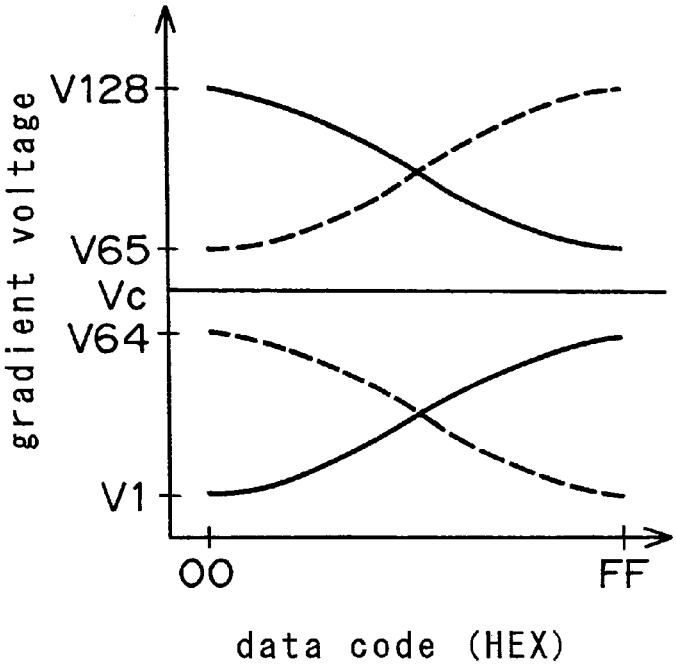
FIG. 17 is a characteristics curve used to explain the operation of the dot inversion drive circuit shown in FIG. 16.

As illustrated in FIG. 11, the first and second N channel decoder areas 77 and 79 are each provided with a plurality of enhancement type N channel transistors and a plurality of depletion type N channel transistors arrayed in a matrix, achieving almost identical structural and functional features to those achieved by the first and second N channel decoder areas 57 and 59 in the third embodiment. In addition, as illustrated in FIG. 12, the first and second P channel decoder areas 81 and 83 are each provided with a plurality of enhancement type P channel transistors and a plurality of depletion type P channel transistors arrayed in a matrix, achieving almost identical structural and functional features to those achieved by the first and second P channel decoder areas 61 and 63 in the third embodiment.

As explained above, in the dot inversion drive circuit in the fourth embodiment, it is possible to select one voltage from among the gradient voltages V1 to V64 in one driver cell, to select one of the gradient voltages V65 to V128 in another driver cell and to switch between the output destinations of the two selected gradient voltages with the selection signal SEL, as in the dot inversion drive circuit in the second embodiment. In addition, the decoders 73 and 75 in the fourth embodiment achieve a reduction in the number of transistors required to constitute them compared to the decoder 5 in the first embodiment while still fulfilling equivalent function to that of the decoder 5, as in the case of the decoder 53 in the third embodiment. Thus, the dot inversion drive circuit in the fourth embodiment achieves further miniaturization compared to the dot inversion drive circuit in the prior art while having almost identical function achieved by the dot inversion drive circuits in the first, second and third embodiments.

While the invention has been particularly shown and described with respect to preferred embodiments thereof by referring to the attached drawings, the present invention is not limited to these examples and it will be understood by those skilled in the art that various changes in form and detail may be made therein without departing from the spirit, scope and teaching of the invention.

For instance, while there are one hundred twenty eight gradient voltages V1 to V128 in the embodiments of the present invention, the number of gradient voltages is not limited to this.

In addition, the data DT are 6-bit data in the third embodiment, the number of bits in the data DT according to the present invention is not limited to this.

Furthermore, while in the decoders 53, 73 and 75 in the third and fourth embodiments, the N channel decoder area and the P channel decoder area are each divided into two areas, each area may be divided into three or more areas to reduce the number of component transistors.

As has been explained, according to the present invention, since simplification in the structure of the driver cells constituting the driver circuit, and in particular, simplification in the structure of the decoders, is achieved, a reduction in the circuit scale is achieved compared to that in the drive circuit for a liquid crystal display apparatus in the prior art. In addition, since the circuit scale of the driver cells is halved according to the present invention, a great reduction in the circuit becomes possible for the entire drive circuit for a liquid crystal display apparatus. Moreover, since the number of transistors constituting the decoders can be reduced according to the present invention, miniaturization of the drive circuit is achieved.

The entire disclosure of Japanese Patent Application No. 9-356294 filed on Dec. 8, 1997 including specification, claims, drawings and summary is incorporated herein by reference in its entirety.

What is claimed is:

1. A drive circuit for a liquid crystal display apparatus that selects one gradient voltage signal from among a plurality of gradient voltage signals, wherein a voltage level of at least one of said gradient voltage signals is lower than a reference voltage level and a voltage level of at least another one of said gradient voltage signals is higher than said reference voltage level, said drive circuit comprising:

a plurality of driver cells, each of said driver cells comprising:

a first decoder, including a plurality of gates having first conductive type transistors that select from among said plurality of gradient voltage signals a first gradient voltage signal having a voltage level that is lower than said reference voltage level, and output the selected first gradient voltage signal to implement continuity control based on the selected first gradient voltage signal, and a second decoder including a plurality of gates having second conductive type transistors that select from among said plurality of gradient voltage signals a second gradient voltage signal having a voltage that is higher than said reference voltage level, and output the selected second gradient voltage signal to implement continuity control based on the selected second gradient voltage signal.

2. A drive circuit, according to claim 1, wherein said second decoder further includes:

a sub decoder that selects a specific number M of gradient voltage signals from among a plurality of input gradient voltage signals, and another sub decoder that selects one gradient voltage signal from among said specific number M of gradient voltage signals.

3. A drive circuit according to claim 1, wherein a number of driver cells corresponds to a number of pixels.

4. A drive circuit according to claim 1, wherein said first decoder further includes:

a plurality of enhancement type N-channel transistors, and a plurality of depletion type N-channel transistors in a matrix array.

5. A drive circuit according to claim 4, wherein a number of said enhancement type N-channel transistors and a number of said depletion type N-channel transistors are set in correspondence to a number of gradient voltage signals.

6. A drive circuit according to claim 1, wherein said second decoder further includes:

a plurality of enhancement type P-channel transistors, and a plurality of depletion type P-channel transistors in a matrix array.

7. A drive circuit according to claim 7, wherein a number of said enhancement type P-channel transistors and a number of said depletion type P-channel transistors are set in correspondence to a number of gradient voltage signals.

8. A drive circuit according to claim 1, wherein said first conductive type transistors are N-channel transistors and said second conductive type transistors are P-channel transistors.

9. A drive circuit for a liquid crystal display apparatus that selects one gradient voltage signal from among a plurality of gradient voltage signals, comprising:

a plurality of driver cells, each of said driver cells comprising:

a first decoder including N-channel transistors that select a gradient voltage signal having a voltage level that is lower than said reference voltage level from said plurality of gradient voltage signals, and a second decoder including P-channel transistors that select a gradient voltage signal having a voltage that is higher than said reference voltage level from said plurality of gradient voltage signals, wherein said first decoder further includes:

a first sub decoder that selects a specific number X of gradient voltage signals from among a plurality of input gradient voltage signals, and a second sub decoder that selects one gradient voltage signal from among said specific number X of gradient voltage signals.

10. A drive circuit according to claim 9, wherein a number of driver cells corresponds to a number of pixels.

11. A drive circuit according to claim 9, wherein said N-channel transistors include a plurality of enhancement type N-channel transistors and a plurality of depletion type N-channel transistors in a matrix array.

12. A drive circuit according to claim 11, wherein a number of said enhancement type N-channel transistors and a number of said depletion type N-channel transistors are set in correspondence to a number of gradient voltage signals.

13. A drive circuit according to claim 9, wherein said P-channel transistors include a plurality of enhancement type P-channel transistors, and a plurality of depletion type P-channel transistors in a matrix array.

14. A drive circuit according to claim 13, wherein a number of said enhancement type P-channel transistors and a number of said depletion type P-channel transistors are set in correspondence to a number of gradient voltage signals.

15. A drive circuit for a liquid crystal display apparatus, that selects one gradient voltage signal from among a plurality of gradient voltage signals, wherein a voltage level of at least one of said gradient voltage signals is lower than a reference voltage level, and a voltage level of at least another one of said gradient voltage signals is higher than said reference voltage level, said drive circuit comprising:

a first driver cell having a first decoder, said first decoder including a plurality of gates having first conductive type transistors that select, from among said plurality of gradient voltage signals, a first gradient voltage signal having a voltage level that is lower than said reference voltage level, and output the selected first gradient voltage signal to implement continuity control based on the selected first gradient voltage signal;

a second driver cell having a second decoder, said second decoder including a plurality of gates having second conductive type transistors that select from among said plurality of gradient voltage signals, a gradient voltage signal having a voltage level that is higher than said reference voltage level, and output the selected second gradient voltage signal to implement continuity control based on the selected second gradient voltage signal; and a selection circuit that selects either the selected first gradient voltage signal or the selected second gradient voltage signal, in conformance to a selection signal.

16. A drive circuit for a liquid crystal display apparatus according to claim 15, wherein said second decoder further includes:

a sub-decoder that selects a specific number M of gradient voltage signals from among a plurality of input gradient voltage signals, and another sub decoder that selects one gradient voltage signal from said specific number M of gradient voltage signals.

17. A drive circuit according to claim 15, wherein said first conductive type transistors are N-channel transistors and said second conductive type transistors are P-channel transistors.

18. A drive circuit for a liquid crystal display apparatus, that selects one gradient voltage signal from among a plurality of gradient voltage signals, wherein a voltage level of at least one of said gradient voltage signals is lower than a reference voltage level, and a voltage level of at least another one of said gradient voltage signals is higher than said reference voltage level, said drive circuit comprising:

a first driver cell having a first decoder, said first decoder including first conductive type transistors that select, from among said plurality of gradient voltage signals, a gradient voltage signal having a voltage level that is lower than said reference voltage level;

a second driver cell having a second decoder, said second decoder including second conductive type transistors that select, from among said plurality of gradient voltage signals, a gradient voltage signal having a voltage level that is higher than said reference voltage level; and a selection circuit that selects either the gradient voltage signal selected by the transistors of said first driver cell or the gradient voltage signal selected by the transistors of said second driver cell, in conformance to a selection signal, wherein said first decoder further includes:

a first sub decoder that selects a specific number X of gradient voltage signals from among a plurality of input gradient voltage signals, and a second sub decoder that selects one gradient voltage signal from among said specific number X of gradient voltage signals.

* * * * *